United States Patent [19]

Kondo

[11] 4,285,097

[45] Aug. 25, 1981

[54] STRUCTURE FOR FIXING A KNOB TO A PART TO BE OPERATED THROUGH THE KNOB

[75] Inventor: Shiro Kondo, Furukawa, Japan

[73] Assignee: Alps Electric Co., Ltd., Tokyo, Japan

[21] Appl. No.: 83,678

[22] Filed: Oct. 11, 1979

Related U.S. Application Data

[63] Continuation of Ser. No. 877,092, Feb. 13, 1978, abandoned.

[30] Foreign Application Priority Data

Feb. 15, 1977 [JP] Japan ..... 52/17075

[51] Int. Cl.[3] ..... E05B 1/00

[52] U.S. Cl. ..... 16/121; 24/113 MP; 24/241 S; 74/558.5; 335/202; 403/14

[58] Field of Search ..... 16/118, 121, 122, 110 R; 403/13, 14; 74/558.5, 553; 24/113 MP, 231, 241 S; 335/202; 250/221, 229, 239

[56] References Cited

U.S. PATENT DOCUMENTS

| | | | |
|---|---|---|---|
| 1,815,596 | 7/1931 | Stark | 16/118 |
| 2,230,916 | 2/1941 | Tinnerman | 16/121 |
| 2,301,169 | 11/1942 | Engstrom | 16/121 |
| 2,706,774 | 4/1955 | Bowman | 16/121 X |
| 3,361,174 | 1/1968 | Bedford, Jr. | 16/121 X |
| 3,386,127 | 6/1968 | Hitzeroth et al. | 16/121 |
| 3,428,344 | 2/1969 | Strange | 16/121 X |
| 3,561,287 | 2/1971 | Lawrence, Jr. | 16/121 X |
| 3,810,052 | 5/1974 | Yanaga . | |
| 3,863,182 | 1/1975 | Lapointe . | |
| 3,906,222 | 9/1975 | Astier et al. . | |

FOREIGN PATENT DOCUMENTS

| | | | |
|---|---|---|---|
| 823415 | 12/1951 | Fed. Rep. of Germany | 16/121 |
| 961599 | 11/1949 | France | 16/121 |
| 1534913 | 6/1968 | France | 16/121 |

*Primary Examiner*—C. J. Husar
*Assistant Examiner*—Moshe I. Cohen
*Attorney, Agent, or Firm*—Guy W. Shoup; Gerard F. Dunne

[57] ABSTRACT

Disclosed is a structure for fixing a knob to a part to be operated through the knob, e.g. a switch of an electric circuit and the like. The fixing relies upon snap-fitting or engagement projections (or recesses) formed on the inner wall of the cap-shaped knob with recesses (or projections) formed on the surface of the part. At least one of the knob and the part is provided with at least one elastic tab unitary therewith, which tab exerts, when the knob is fitted to the part, a resilient force to bias the inner wall of the knob away from the part, so as to eliminate the shakiness of the knob on the part, affording a stable and safe fixing without necessitating unextraordinarily high dimensional precision of the knob and the part.

2 Claims, 5 Drawing Figures

STRUCTURE FOR FIXING A KNOB TO A PART TO BE OPERATED THROUGH THE KNOB

This application is a continuation of copending application Ser. No. 877,092 filed Feb. 13, 1978 and now abandoned.

BACKGROUND OF THE INVENTION

The present invention relates to a structure for fixing a knob to a part, such as a switch of an electric circuit or the like, adapted to be operated through the knob and, more particularly, to a structure for fixing a cap-shaped knob to a part by a snap fit.

In conventional snap fit structures for fixing a knob to a part, the two members are usually made of resilient materials, and a convexity of one of the two members is press-fitted into a concavity formed in the other member, through elastic deformation of the members. However, this type of fixing structure requires, especially when the knob is a cap-shaped one adapted to be fitted around a boss or protrusion of the objective part, a high dimensional accuracy, in order that the knob may be correctly fitted without any shakiness. This in turn requires a highly accurate control of the shaping or molding process, resulting in considerably high cost of production.

The present invention aims at overcoming the above described problem of the prior art.

SUMMARY OF THE INVENTION

It is therefore an object of the present invention to provide a structure for fixing, stably and safely, a knob to a part without causing any shakiness of the knob, at a reasonable cost of production.

To this end, according to the present invention, there is provided a structure for fixing a knob to a part to be operated through the knob, wherein said knob is fixed to the part through an engagement of a least one convexity formed on one of said knob and said part with a corresponding concavity formed in the other, characterized by comprising at least one elastic piece or tab formed unitarily on the surface of one of said knob and said part and confronting the other.

The above and other objects, as well as advantageous features of the invention will become clear from the following description of the preferred embodiment taken in conjunction with the attached drawings in which:

BRIEF DESCRITPION OF THE DRAWINGS

FIGS. 1 and 2 are side elevational sectional views of essential parts of a conventional knob-fixing structure, FIG. 3 is an exploded perspective view of a switch incorporating a knob-fixing structure in accordance with the present invention, and FIGS. 4A and 4B are illustrations explanatory of the manner in which a knob is fixed to a part by means of the structure as shown in FIG. 3.

DETAILED DESCRIPTION OF THE PREFERRED EMBODIMENTS

Before turning to the description of the preferred embodiment, an explanation will be made as to conventional knob-fixing structures, with specific reference to FIGS. 1 and 2, in order to clarify the problems of the prior art.

Figure 1:
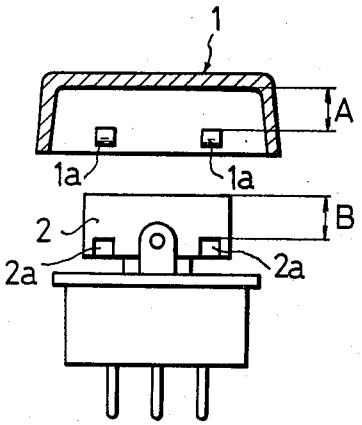
Fig. 1 PRIOR ART
Figure 2:
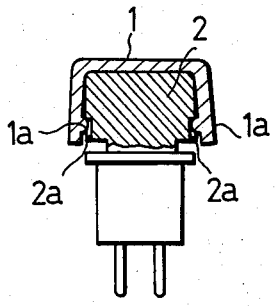
Fig. 2 PRIOR ART

Referring to FIGS. 1 and 2 showing, in section, essential parts of a conventional knob-fixing structure of snap-fit type, the fitness of the structure is largely affected by the relationship between the height A of the lower surface of the cover portion of a knob 1 as measured from a projection or convexity 1*a* on the same, and a height B of the top surface of a part 2 to which the knob is to be fixed as measured from the recess or convavity 2*a* formed in the part 2.

More specifically, assuming that the height A is smaller than the height B, the knob is unstably supported in a floating manner upon the part 2, because the convexity and the concavity cannot engage each other properly, making the assembly practically unusable, as will be seen from FIG. 2.

To the contrary, assuming that the height A is greater that the height B, a gap is formed between the convexity 1*a* of the knob 1 and the convavity 2*a* of the part 2, causing a shakiness of the knob 1 during operating, imparting a bad feel of use to the operator.

In order that the knob is stably fixed to the part without shakiness, it is necessary to make the heights A and B as close as possible to one another, which can, however, be obtained only through a highly accurate shaping of the knob and the part and a severe control of the same, inevitably resulting in a high cost of production.

Figure 3:
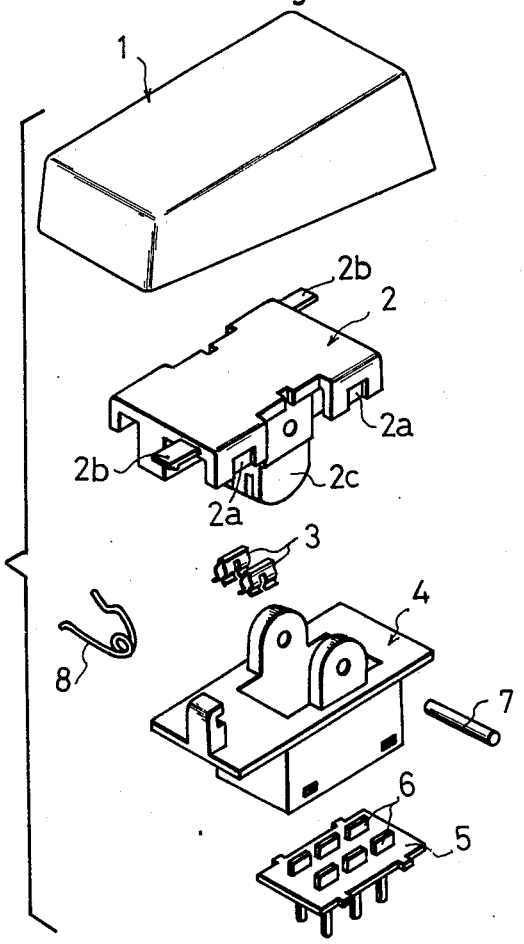

However, the knob-fixing structure of the invention can provide a stable and safe fixing of the knob to the part, avoiding any shakiness of the knob, without necessitating such a high dimensional accuracy of the heights A and B as in the conventional structure, and, therefore, is entirely free from the above described problems of the prior art, as will be seen from the following description of a preferred embodiment taken in conjunction with FIGS. 3 and 4, in which the same reference numerals are used for elements similar to those in the aforementioned convention structure.

Figure 4A:
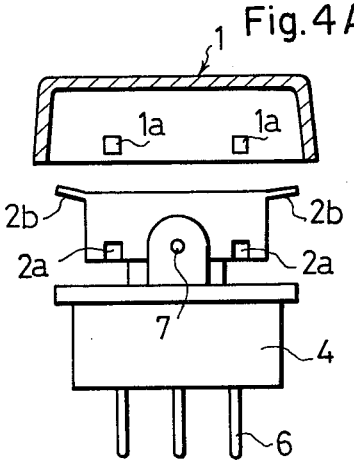
Figure 4B:
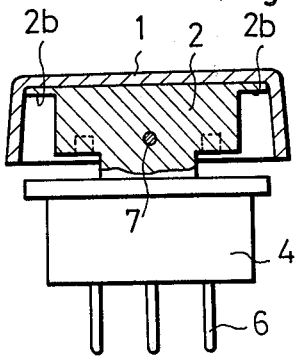

Referring to FIGS. 3 through 4B inclusive, reference numeral 1 denotes a knob made of a synthetic plastic material. The knob 1 is provided on its inner wall with one or more projections or convexities 1*a*. A part 2 which is to be operated through the knob 1 is also made of a synthetic plastic material, and is provided with one or more recesses or concavities 2*a*. The part 2 also has elastic and resilient tabs 2*b* formed unitarily with the part 2, and a housing 2*c* for movable contacts 3. Numeral 4 denotes a switch housing, while numeral 5 denotes a base plate on which stationary or fixed contacts 6 are provided. The part 2 is rotatably supported on the housing 4, through a shaft 7. Numeral 8 denotes a spring. As will be seen from FIG. 4A, the elastic tabs 2*b* extend to a height slightly above the plane of the upper surface of the part 2.

In fixing the knob 1 to the part 2, at first the knob 1 is fitted down on the part 2, with the convexities 1*a* of the inner wall of the knob 1 being vertically aligned with the concavities 2*a* of the part 2. Then, as the knob 1 is strongly pressed onto the part 2, the convexities 1*a* come into engagement with the concavities 2*a*, while the ends of the elastic tabs 2*b* come to abut the inner wall of the knob 1.

It will be seen that the resiliency or elasticity of the tabs 2*b* acts to bias the part 2 away from the inner wall of the knob 1, so as to eliminate the shakiness of the knob relative to the part. As will be apparent to those skilled in the art, the tabs or pieces 2*b* may just as well be formed unitarily on the knob.

As has been described, according to the invention, there is provided a less costly snap-fit type structure for fixing a knob to a part adapted to be operated through the part, relying upon an engagement of concavities and convexities formed on the knob and the part, in which at least one of the knob and the part, so as to eliminate the shakiness of the knob, affording a stable and safe fixing.

Having described the invention with specific reference to a preferred embodiment, it is to be noted here that various changes and modifications may be imparted to the described embodiment without departing from the spirit and scope of the invention which is defined by the appended claims.

What is claimed is:

1. In a structure for fixing a generally cap-shaped knob over a part to be operated by said knob, including at least one set of co-engaging structures formed respectively on said knob and said part, each said set of co-engaging structures being constituted by a concavity and a corresponding convexity formed on the inner surface of said knob and a facing outer surface of said part, respectively, at locations thereon spaced downwardly from the upper surface thereof, the improvement comprising two elastic tabs respectively extending oppositely from opposing outer surfaces of said part, said tabs each extending to a height slightly above the upper surface of said part and extending to the inner surface of said knob whereby said knob can be fitted over said part with said co-engaging structures properly aligned by said tabs engaging said inner surfaces of said knob and, when said structures are co-engaged, said tabs will urge said structures into firm engagement.

2. A structure according to claim 1, said knob and said part being each generally rectangular, one of said tabs extending outwardly along one longitudinal edge of said part and the other of said tabs extending outwardly along the outer longitudinal edge of said part.

* * * * *